US010619290B2

(12) United States Patent
Nam et al.

(10) Patent No.: US 10,619,290 B2
(45) Date of Patent: Apr. 14, 2020

(54) CLOTHES DRYER

(71) Applicant: LG ELECTRONICS INC., Seoul (KR)

(72) Inventors: Hyunsu Nam, Seoul (KR); Manseok Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 812 days.

(21) Appl. No.: 15/238,191

(22) Filed: Aug. 16, 2016

(65) Prior Publication Data

US 2017/0051449 A1 Feb. 23, 2017

(30) Foreign Application Priority Data

Aug. 17, 2015 (KR) ..... 10-2015-0115523

(51) Int. Cl.
*D06F 58/24* (2006.01)
*D06F 58/20* (2006.01)

(52) U.S. Cl.
CPC ..... *D06F 58/24* (2013.01); *D06F 58/20* (2013.01)

(58) Field of Classification Search
USPC ..... 34/73
See application file for complete search history.

(56) References Cited

U.S. PATENT DOCUMENTS 2,742,708 A * 4/1956 McCormick ..... D06F 58/02 34/60
7,891,206 B2 * 2/2011 Yoon ..... F24F 3/14 220/23.87
2005/0132593 A1 * 6/2005 Doh ..... D06F 58/24 34/73
2005/0138831 A1 * 6/2005 Lee ..... D06F 58/24 34/73
2005/0278972 A1 * 12/2005 Maruca ..... D06F 58/10 34/201
2006/0278084 A1 * 12/2006 Kim ..... B01D 53/261 96/140
2006/0278085 A1 * 12/2006 Kim ..... B01D 53/261 96/140
2008/0000098 A1 * 1/2008 Choi ..... D06F 58/04 34/114

(Continued)

FOREIGN PATENT DOCUMENTS

CN 103898727 A 7/2014
CN 104619905 A 5/2015

(Continued)

*Primary Examiner* — Edelmira Bosques
*Assistant Examiner* — Bao D Nguyen
(74) *Attorney, Agent, or Firm* — Dentons US LLP

(57) ABSTRACT

A clothes dryer including a cabinet, a drum, a condenser, a sump, a drawer, a hose, a condensate pump, and a condensed water container. The drawer includes a bucket for receiving condensed water which overflows from the condensed water container, and a condensate discharge pipe formed at the bucket to discharge condensed water collected in the bucket. When the drawer is stored in the cabinet, the sump is connected to the condensate discharge pipe such that condensed water introduced through the condensate discharge pipe is returned to the sump. When the drawer is withdrawn from the cabinet, the sump includes a sump connection pipe separated from the condensate discharge pipe.

6 Claims, 13 Drawing Sheets

(56) References Cited

U.S. PATENT DOCUMENTS

2008/0141558 A1* 6/2008 Bae ..... D06F 58/04 34/595
2008/0271263 A1* 11/2008 Bae ..... D06F 58/203 8/159
2008/0276659 A1* 11/2008 Bae ..... D06F 39/008 68/5 C
2008/0276660 A1* 11/2008 Bae ..... D06F 58/04 68/5 C
2009/0260246 A1* 10/2009 Bae ..... D06F 58/203 34/60
2009/0265953 A1* 10/2009 Bae ..... D06F 58/203 34/467
2009/0307921 A1* 12/2009 Bae ..... D06F 58/203 34/60
2009/0320313 A1* 12/2009 Bae ..... D06F 39/008 34/132
2010/0000117 A1* 1/2010 Choi ..... D06F 58/203 34/443
2010/0058605 A1* 3/2010 Kang ..... D06F 58/20 34/85
2010/0071224 A1* 3/2010 Chung ..... D06F 58/24 34/218
2010/0072187 A1* 3/2010 Uno ..... F24C 15/02 219/392
2010/0139111 A1* 6/2010 Favret ..... D06F 58/24 34/76
2010/0162584 A1* 7/2010 Ahn ..... D06F 58/24 34/73
2010/0192397 A1* 8/2010 Kim ..... D06F 58/206 34/73
2011/0047813 A1* 3/2011 Kuhl ..... D06F 58/206 34/468
2011/0114135 A1* 5/2011 Baurmann ..... D06F 58/20 134/26
2011/0162224 A1* 7/2011 Bae ..... D06F 58/203 34/60
2011/0277334 A1* 11/2011 Lee ..... D06F 58/203 34/73
2011/0277336 A1* 11/2011 Shin ..... D06F 58/22 34/130
2011/0289796 A1* 12/2011 Ha ..... D06F 58/28 34/468
2012/0005912 A1* 1/2012 Lee ..... D06F 58/22 34/73
2012/0096901 A1* 4/2012 Zattin ..... D06F 39/02 68/13 R
2012/0159997 A1* 6/2012 Del Pos ..... D06F 39/022 68/13 R
2013/0312275 A1* 11/2013 Castiglione ..... D06F 58/20 34/73
2014/0013616 A1* 1/2014 Lee ..... F26B 21/086 34/524
2014/0298671 A1* 10/2014 Lee ..... D06F 58/24 34/108
2014/0352333 A1* 12/2014 Marioni ..... F04D 15/0218 62/56
2015/0285531 A1* 10/2015 Lee ..... B65D 25/30 62/271
2015/0308732 A1* 10/2015 Lee ..... F25D 21/14 62/291
2016/0010882 A1* 1/2016 Lee ..... F24F 3/1405 312/228
2016/0083894 A1* 3/2016 Bison ..... D06F 58/24 34/85
2016/0115643 A1* 4/2016 Bison ..... D06F 58/24 34/468
2016/0138209 A1* 5/2016 Kitayama ..... D06F 58/24 34/499
2017/0002509 A1* 1/2017 Nam ..... D06F 58/24
2018/0148885 A1* 5/2018 Kitayama ..... D06F 58/02

FOREIGN PATENT DOCUMENTS

| | | | |
|---|---|---|---|
| CN | 106319902 | A | 1/2017 |
| CN | 106319903 | A | 1/2017 |
| CN | 106319911 | A | 1/2017 |
| EP | 1990466 | A1 | 11/2008 |
| EP | 2669420 | A1 | 12/2013 |
| KR | 10-0607276 | B1 | 7/2006 |
| KR | 10-0648173 | B1 | 11/2006 |
| KR | 10-2014-0095741 | A | 8/2014 |
| KR | 10-1435797 | B1 | 8/2014 |
| KR | 10-2014-0121003 | A | 10/2014 |
| WO | 2015-101388 | A1 | 7/2015 |

* cited by examiner

CLOTHES DRYER

CROSS-REFERENCE TO RELATED APPLICATION

This application claims the priority benefit of Korean Patent Application No. 10-2015-0115523, filed on Aug. 17, 2015 in the Korean Intellectual Property Office, the disclosure of which is incorporated herein by reference.

BACKGROUND

1. Field

The present disclosure relates to a condensation type clothes dryer.

2. Description of the Related Art

Generally, a clothes dryer is an apparatus that supplies dry air into a drum in which clothes are placed in order to dry the clothes. The clothes dryer may be classified as an exhaust type clothes dryer or a condensation type clothes dryer. The exhaust type clothes dryer exhausts air discharged from a drum out of the clothes dryer without circulation. The condensation type clothes dryer includes a circulation path for circulating air passing through a drum. A condenser for condensing moisture in the air is mounted on the circulation path.

In the case of the condensation type clothes dryer, a container for collecting water (hereinafter, referred to as "condensed water") generated by the condenser is provided. Such a container is detachably disposed at the clothes dryer. After the container is separated from the clothes dryer by a user, the collected condensed water in the container may be removed.

However, condensed water may be over-generated in a drying process such that condensed water exceeds a capacity of the container. In this case, a disposal method of the excess condensed water is needed. If a user frequently confirms the amount of condensed water collected in the container and empties the container before operating the clothes dryer, the lack of the capacity may be prevented. To solve a problem of inconvenience, a clothes dryer, in which the amount of condensed water collected in the container is sensed and a time to empty the container is announced, is provided. During an operation mode, when the container is full, such a clothes dryer informs the user and automatically stops operation. However, although technology, in which the capacity of a clothes dryer is increased, is on the rise, there is a limitation on extension of an appearance of the clothes dryer due to the standard for installation. Research into the maximum volume of a drum in a determined area has been carried out in order to increase the capacity. However, increasing the capacity of the container for storing condensed water conflicts with increasing volume of the drum.

Thus, despite limited capacity of the container for storing condensed water, the excess amount of condensed water needs to be stored.

SUMMARY

It is an object of the present disclosure to provide a clothes dryer capable of disposing of the excess of condensed water.

It is another object of the present disclosure to provide a clothes dryer, in which although the collected condensed water exceeds the capacity of a container for condensed water, the clothes dryer does not immediately stop, but the excess of condensed water is guided into a certain space formed at a base, thereby continuing a normal operation of the clothes dryer in process.

It is another object of the present disclosure to provide a clothes dryer including a condensed water container stored in a drawer to collect condensed water collected in a chamber and an overflow path capable of returning excess condensed water, which exceeds the capacity of the condensed water container, into the chamber.

It is another object of the present disclosure to provide a clothes dryer capable of preventing a countercurrent of condensed water in a chamber through an overflow path although a drawer is withdrawn from a cabinet.

It is a further object of the present disclosure to provide a clothes dryer in which an overflow path prevents humid air in a circulation path from leaking out of the clothes dryer.

In accordance with the present disclosure, the above and other objects can be accomplished by the provision of a clothes dryer including a cabinet, a drum rotatably disposed in the cabinet to accommodate clothes, a condenser, disposed in a circulation path passing through the drum, to condense humid air exhausted from the drum, a sump, disposed in the circulation path, to collect condensed water generated by the condenser, a drawer withdrawably stored in the cabinet, a hose connected to the sump, a condensate pump to transfer condensed water in the sump through the hose, and a condensed water container separably stored in the drawer, wherein the condensed water transferred through the hose is introduced into the condensed water container in the case that the drawer is stored in the cabinet, wherein the drawer includes a bucket to receive condensed water exceeded from the condensed water container, and a condensate discharge pipe formed at the bucket to discharge condensed water collected in the bucket, wherein when the drawer is stored in the cabinet, the sump is connected to the condensate discharge pipe such that condensed water introduced through the condensate discharge pipe is guided to the sump to be returned, wherein the drawer is withdrawn from the cabinet, the sump includes a sump connection pipe separated from the condensate discharge pipe.

BRIEF DESCRIPTION OF THE DRAWINGS

The above and other objects, features, and other advantages of the present disclosure will be more clearly understood from the following detailed description taken in conjunction with the accompanying drawings, in which.

DETAILED DESCRIPTION

The advantages, features, and methods for achieving those of embodiments may become apparent upon referring to embodiments described later in detail together with the attached drawings. However, the embodiments are not so limited, but may be embodied in different modes. The embodiments are provided for completeness of disclosure and to inform the scope thereof to persons skilled in this field of art. The same reference numbers may refer to the same elements throughout the specification.

Figure 1:
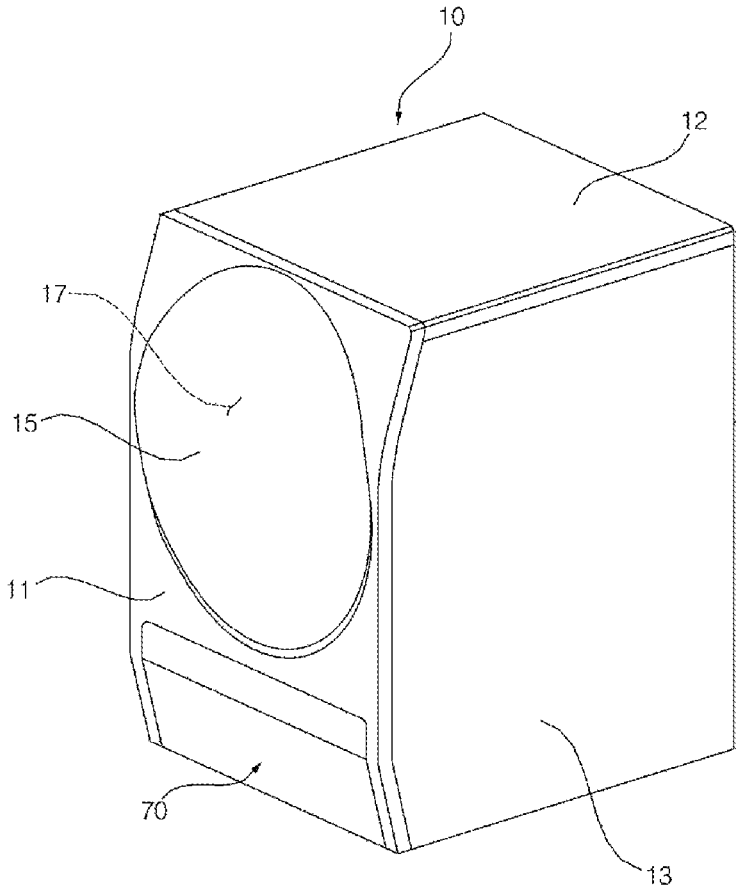
FIG. 1 is a perspective view illustrating a clothes dryer according to an embodiment of the present invention.
Figure 2:
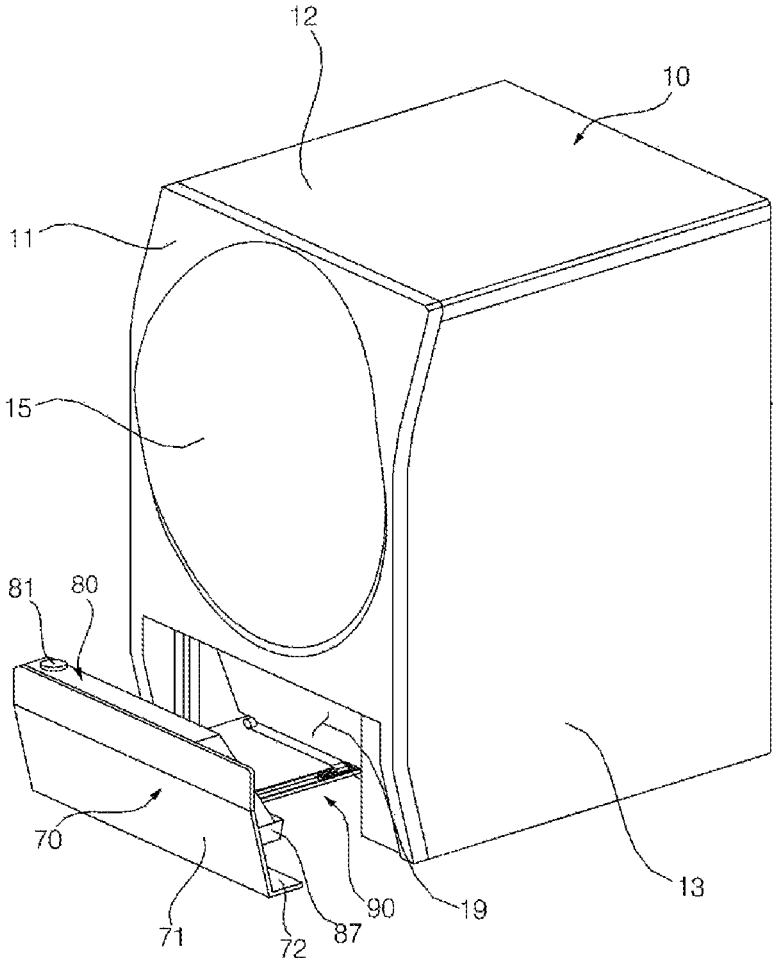
FIG. 2 illustrates a withdrawn state of a drawer assembly.
Figure 3:
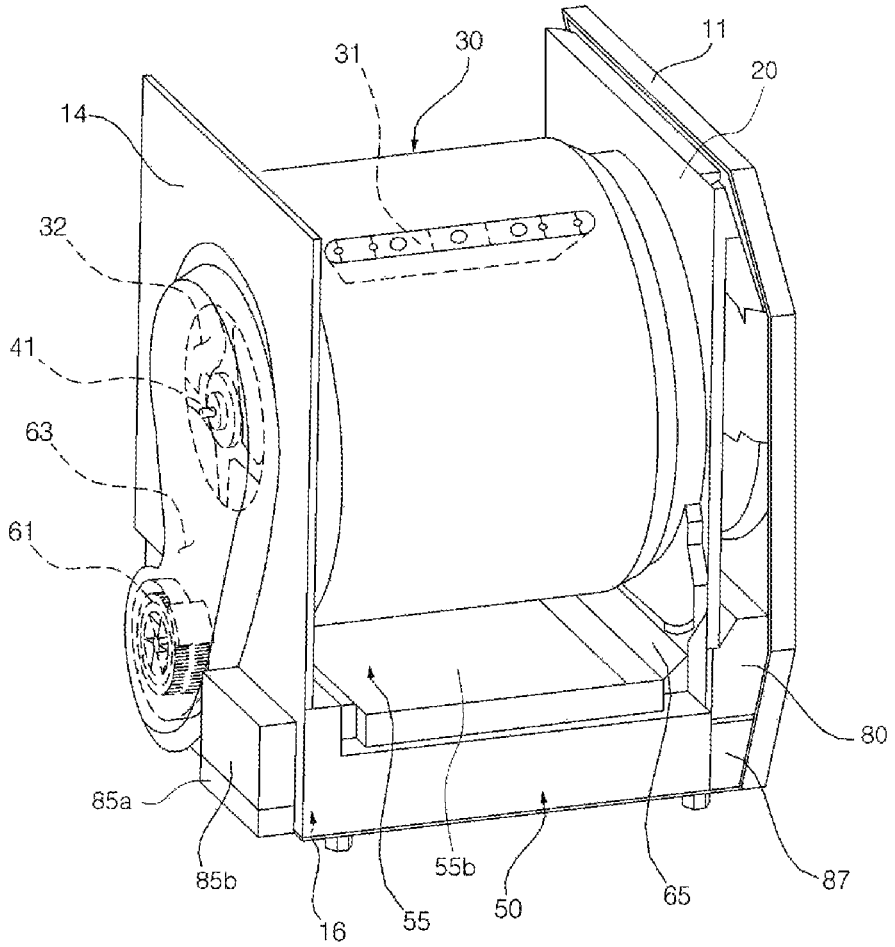
FIG. 3 illustrates main constituents of the clothes dryer according to the illustrated embodiment of the present invention.
Figure 4:
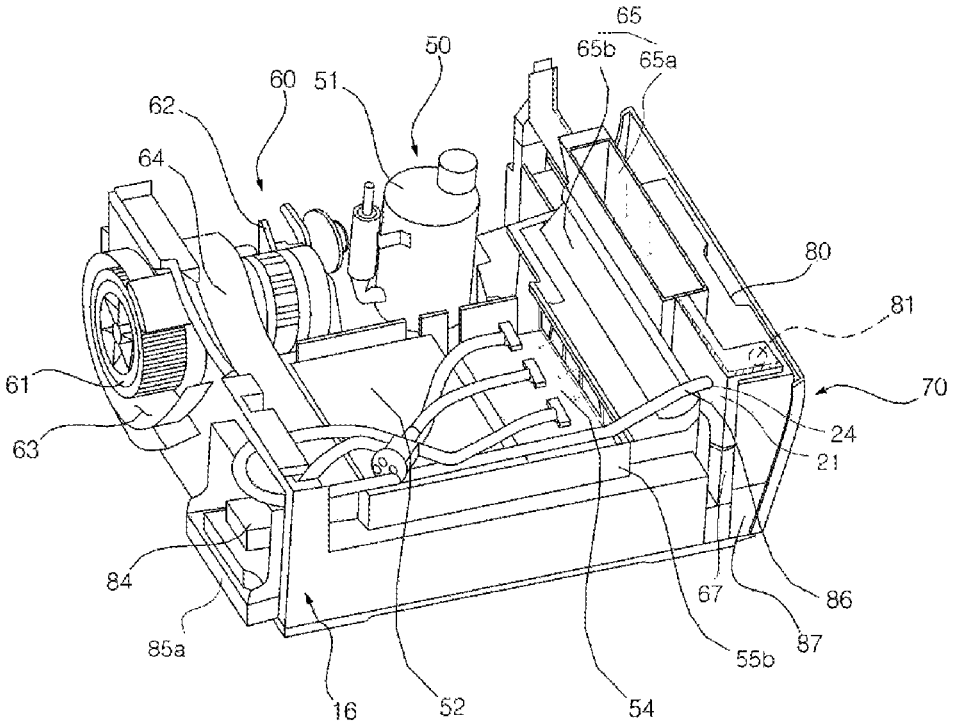
FIGS. 4 and 5 illustrate a main part of the clothes dryer according to the illustrated embodiment of the present invention.
Figure 5:
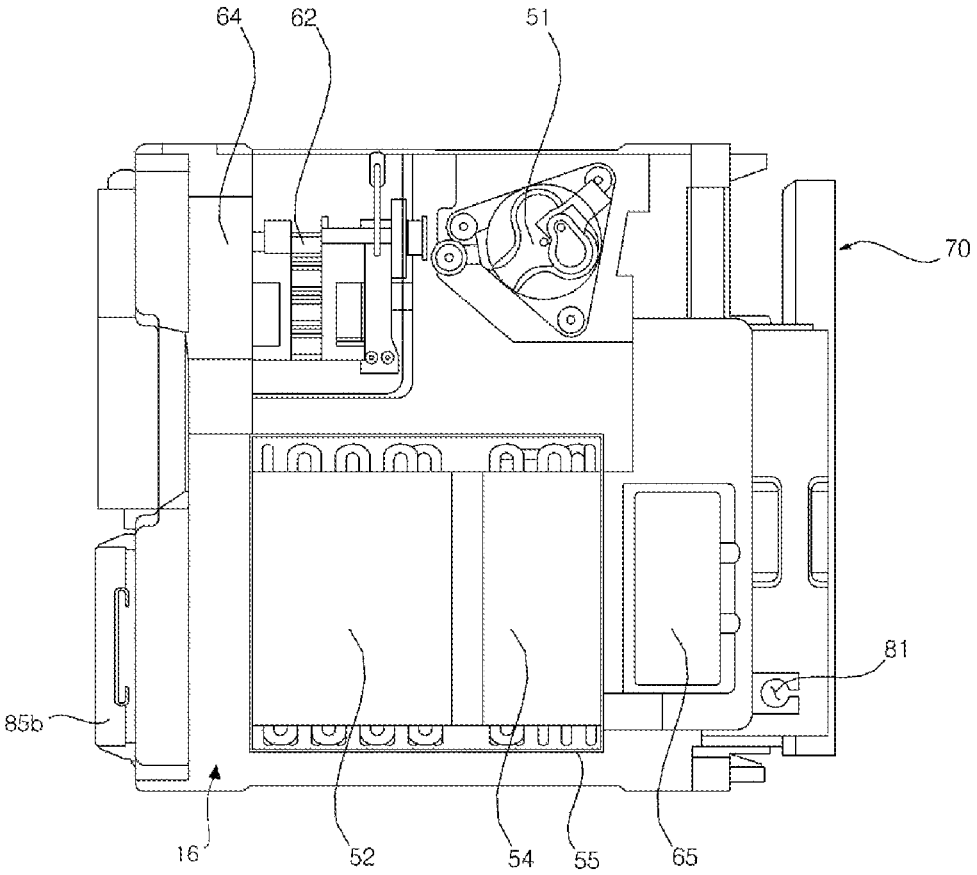
Figure 6:
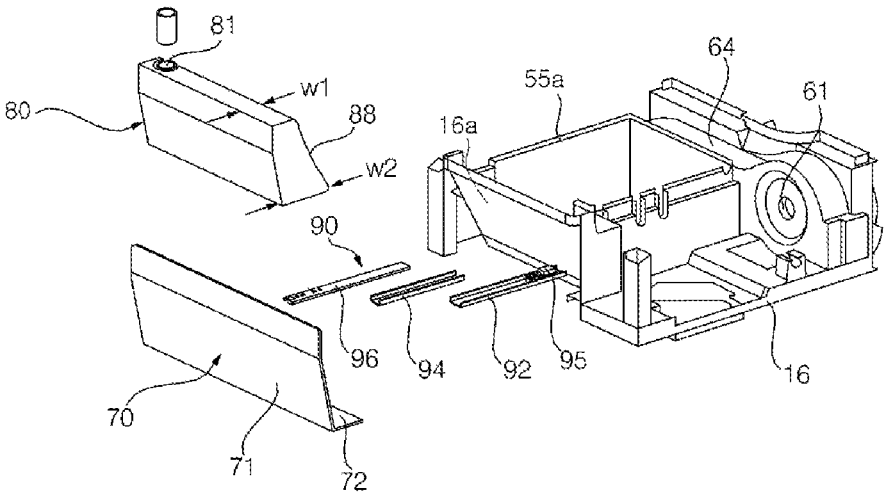
FIG. 6 is an exploded view of the drawer assembly illustrated in FIG. 2.
Figure 7:
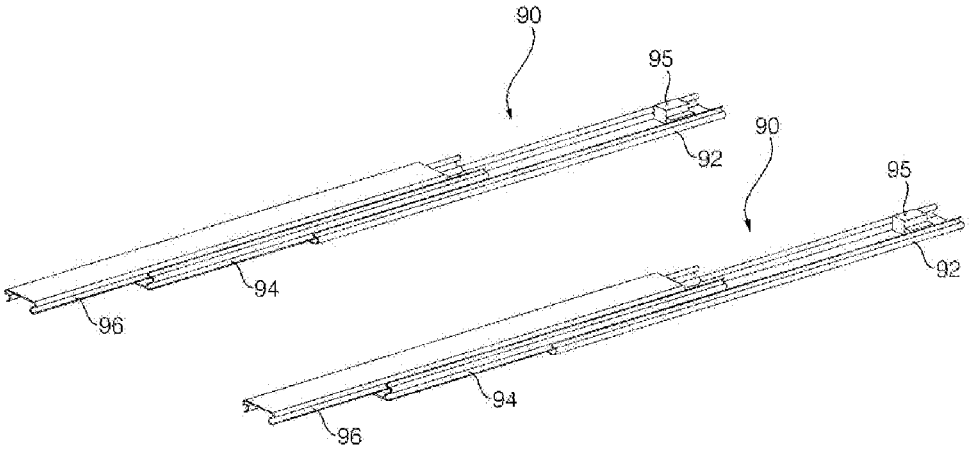
FIG. 7 illustrates a guide supporter illustrated in FIG. 2.
Figure 8:
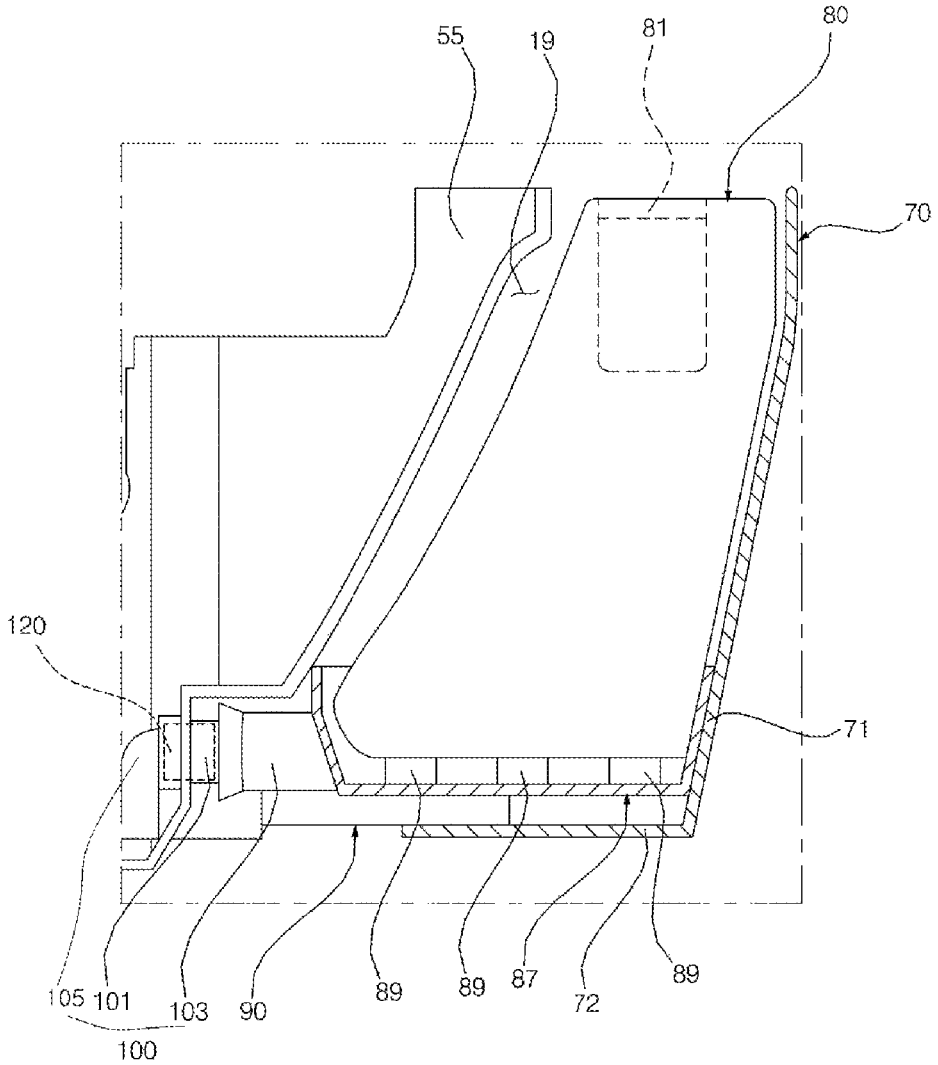
FIG. 8 is a cross-sectional view of the clothes dryer in the state that a condensed water container is stored therein.
Figure 9:
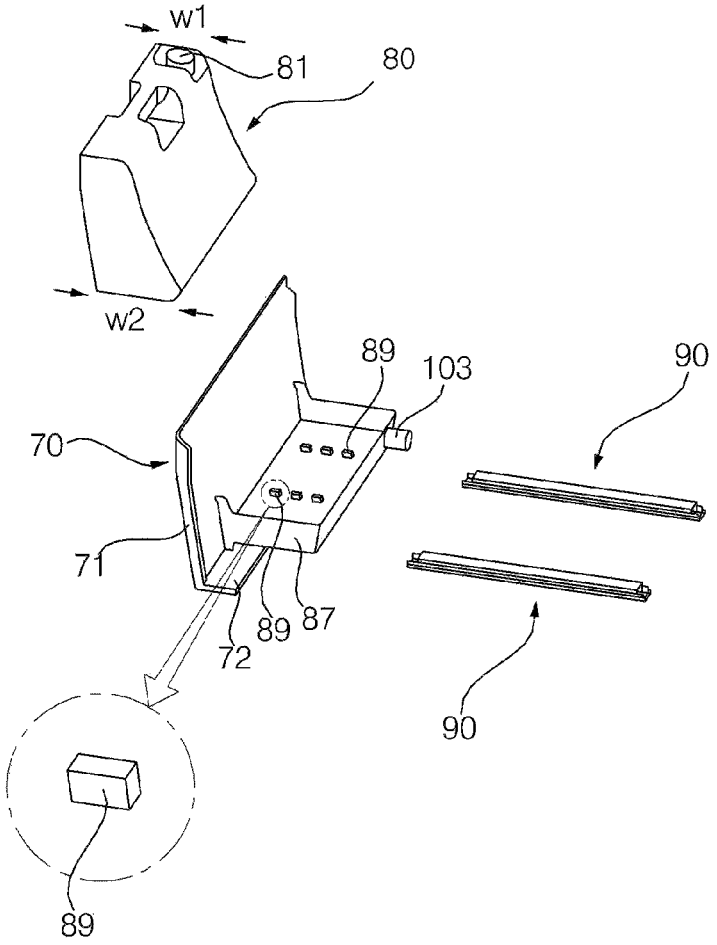
FIG. 9 is an exploded perspective view illustrating a rear side of the drawer assembly.
Figure 10:
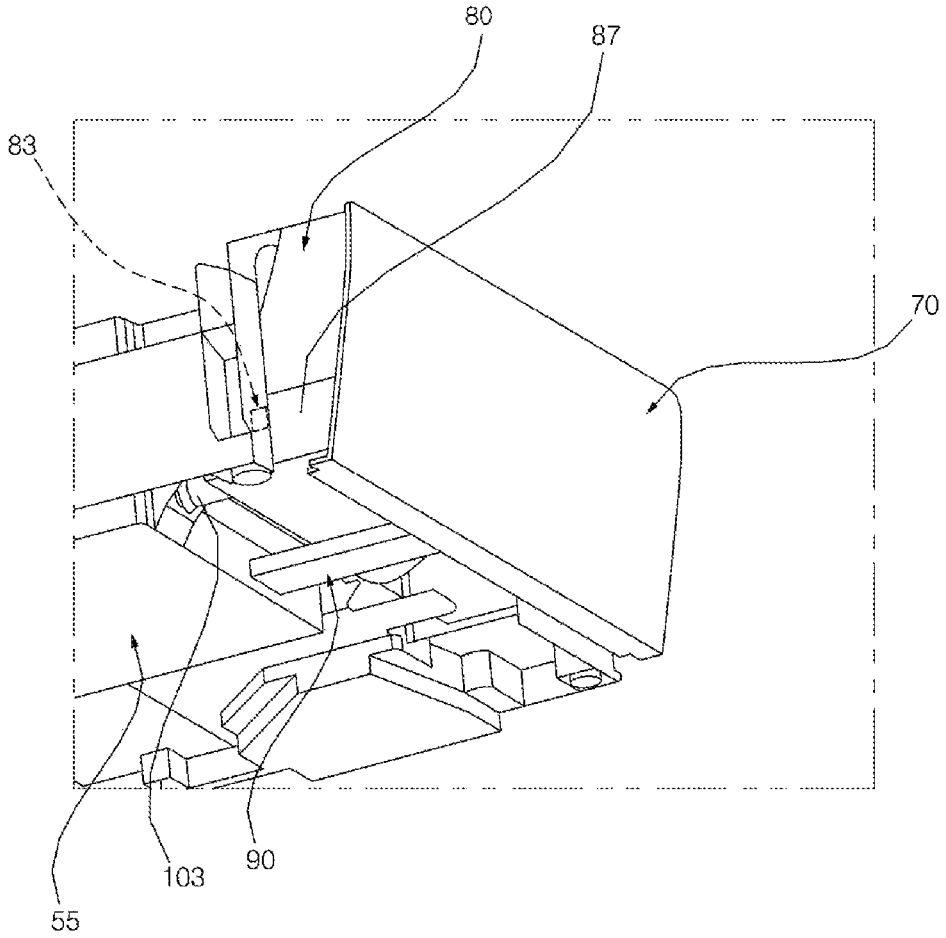
FIG. 10 illustrates the drawer assembly in a stored state.
Figure 11:
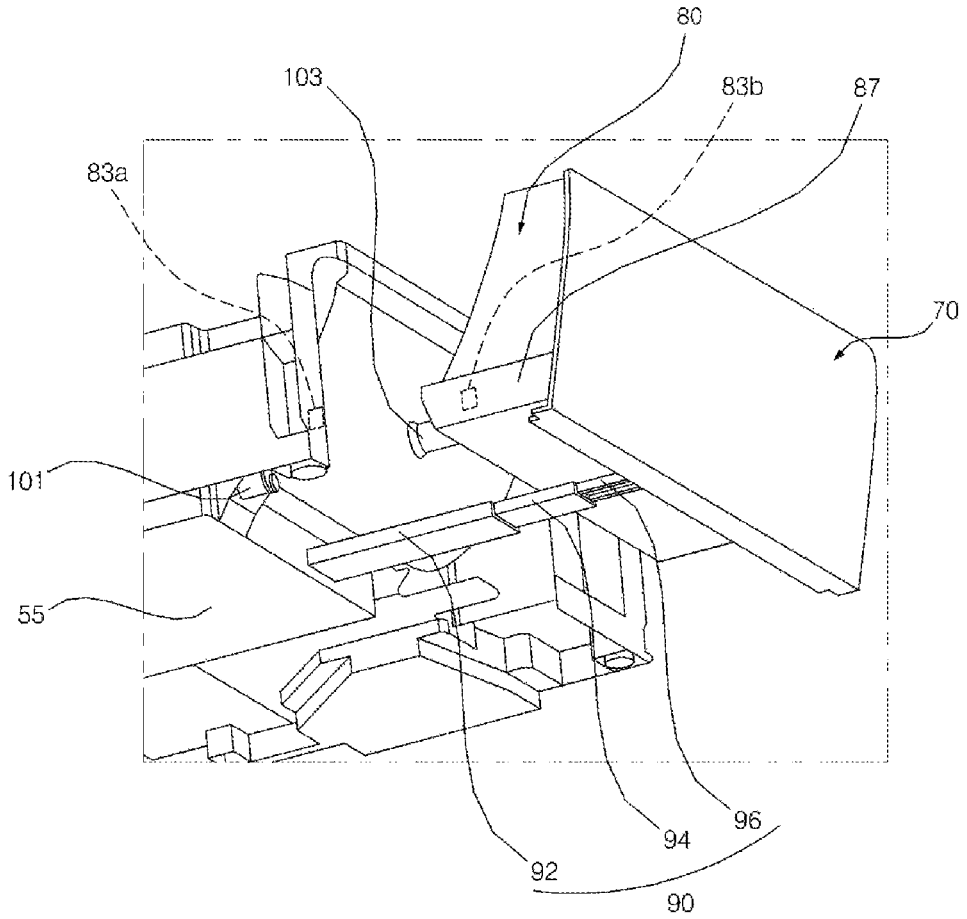
FIG. 11 illustrates the drawer assembly in a withdrawn state.
Figure 12:
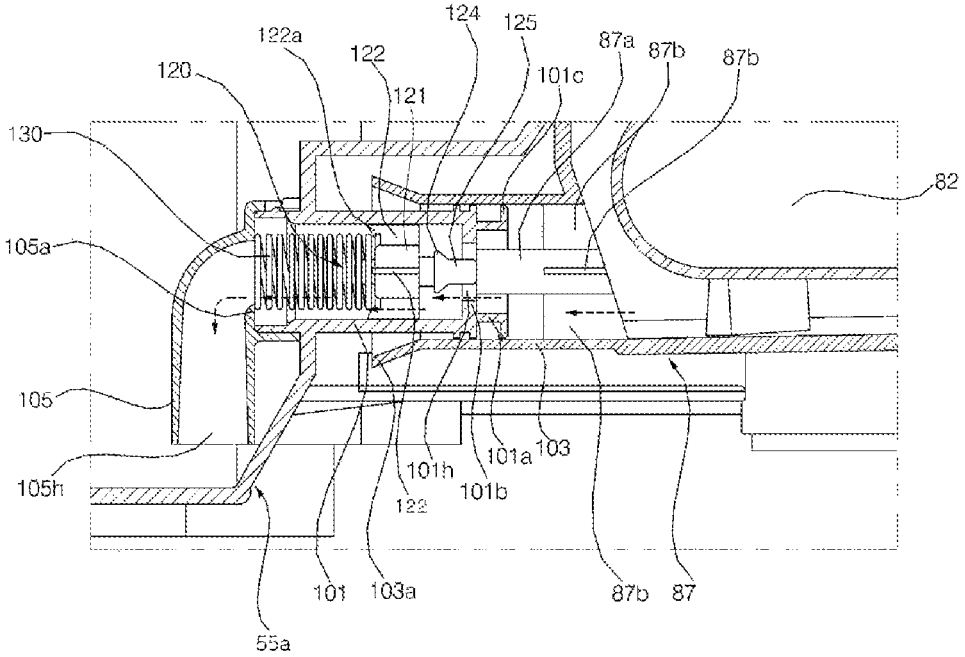
FIG. 12 illustrates an overflow path in the case that the drawer assembly is stored.
Figure 13:
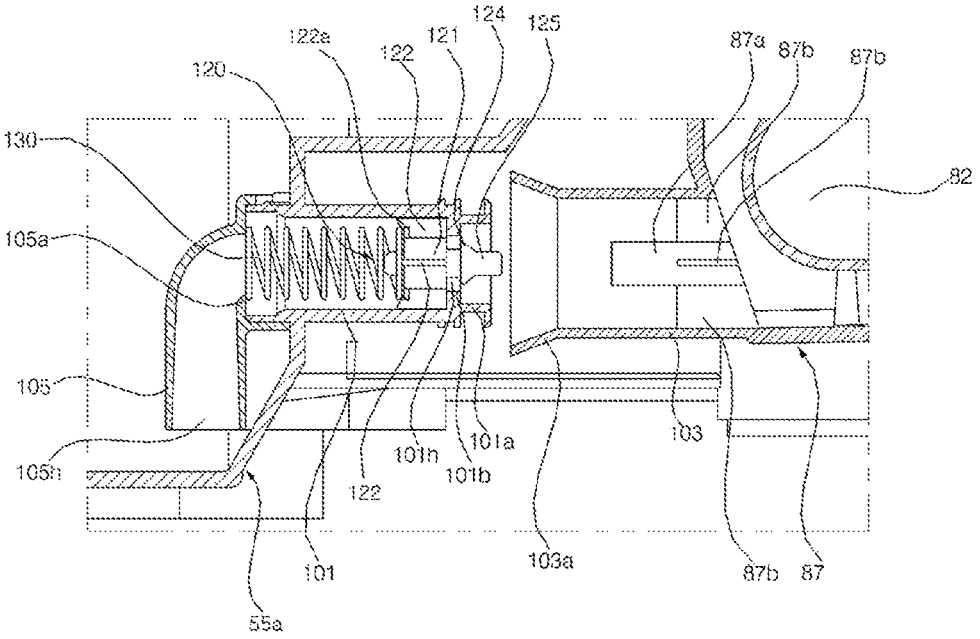
FIG. 13 illustrates the overflow path in the case that the drawer assembly is withdrawn.

FIG. 1 is a perspective view illustrating a clothes dryer according to an embodiment of the present invention. FIG. 2 illustrates a withdrawn state of a drawer assembly. FIG. 3 illustrates main constituents of the clothes dryer according to the illustrated embodiment of the present invention. FIGS. 4 and 5 illustrate a main part of the clothes dryer according to the illustrated embodiment of the present invention. FIG. 6 is an exploded view of the drawer assembly illustrated in FIG. 2. FIG. 7 illustrates a guide supporter illustrated in FIG. 2. FIG. 8 is a cross-sectional view of the clothes dryer in the state that a condensed water container is stored therein. FIG. 9 is an exploded perspective view illustrating a rear side of the drawer assembly. FIG. 10 illustrates the drawer assembly in a stored state. FIG. 11 illustrates the drawer assembly in a withdrawn state. FIG. 12 illustrates an overflow path in the case that the drawer assembly is stored. FIG. 13 illustrates the overflow path in the case that the drawer assembly is withdrawn.

Referring to FIGS. 1 to 3, the clothes dryer according to an embodiment of the present invention, may include a cabinet 10 forming a certain space, in which various devices are mounted, while having an entrance opening 17 formed at a front surface thereof to introduce/withdraw clothes, and a door 15 rotatably mounted at cabinet 10 to open/close entrance opening 17.

Cabinet 10 may include a front panel 11, a top plate 12, side panels 13, a rear panel 14, and a base 16. Front panel 11 is configured to form the front surface of cabinet 10. Entrance opening 17 is formed at front panel 11 to introduce/withdraw the clothes in/from a drum 30. A door 15 may be rotatably connected to front panel 11. In addition, a front surface, a rear surface, and side surfaces of cabinet 10 may be formed by top plate 12, rear panel 14, and side panels 13, respectively. Side panels 13 may be formed at a right surface and a left surface of cabinet 10, respectively.

Drum 30 may be rotatably supported by a drum supporter 20. A front surface of drum 30 is opened. A ring-shaped front end corresponding to a circumference of the opened part of drum 30 may be supported by drum supporter 20. A ring-shaped supporting surface or groove for supporting the front end of drum 30 may be formed at drum supporter 20.

An opening may be formed at drum supporter 20 to introduce a bag into drum 30. The opening may communicate with entrance opening 17 of front panel 11. A plurality of lifters 31 may be disposed on an inner circumferential surface of drum 30 to draw the clothes up. Each of lifters 31 may be disposed to have a certain angle with respect to a rotation axis of drum 30.

According to the illustrated embodiment, a pair of rollers may be provided at drum supporter 20 to support an outer circumferential surface of drum 30. The rollers may be disposed to be spaced from each other in a width direction of the clothes dryer.

Referring to FIGS. 4 and 5, a motor 62 for rotating drum 30 may be provided. Drum 30 may be rotated by a belt-driven method. In this case, a belt (not shown) may be wound at the outer circumferential surface of drum 30. As the belt is transferred by a pulley (not shown) which is rotated by motor 62, a rotation of drum 30 may be performed.

Various devices constituting the clothes dryer may be mounted on base 16. Drum supporter 20, side panels 13 and/or rear panel 14 may be coupled to base 16, thereby being supported. Front panel 11 may be coupled to a front surface of drum supporter 20.

Referring to FIGS. 3 to 5, a chamber 55 may be formed at base 16. An exhaust air duct 65 for guiding air exhausted from drum 30 to chamber 55 formed at base 16 may be provided.

Referring to FIG. 4, exhaust air duct 65 may include a first exhaust air duct 65*a* formed at drum supporter 20, and a second exhaust air duct 65*b* formed as a separate device away from drum supporter 20. Second exhaust air duct 65*b* may be arranged below first exhaust air duct 65*a*. An outlet of first exhaust air duct 65*a* may be connected to an inlet of second exhaust air duct 65*b*. Second exhaust air duct 65*b* may be connected to base 16.

An outlet (not shown) may be formed at drum supporter 20 to exhaust air from drum 30. The outlet corresponds to an inlet of first exhaust air duct 65*a* such that air introduced into the outlet from drum 30 is guided along first exhaust air duct 65*a* and then is introduced into chamber 55 through second exhaust air duct 65*b*.

Drum supporter 20 may include a pair of supporting legs 21 spaced apart from each other in a lateral direction of the clothes dryer. A pair of supporter mounts 67 for mounting supporting legs 21 may be formed at base 16.

An air filter (not shown) may be disposed in exhaust air duct 65. The air filter may collect foreign substances such as a thread floating in the air. The air filter may be separably mounted at drum supporter 20 to empty the collected foreign substances by a user.

A circulation path for guiding air to circulate through drum 30 may be formed. A heat pump 50 for heating air, which flows along the circulation path, may be provided. The circulation path is formed to guide air exhausted from drum 30 into drum 30. The above-described exhaust air duct 65 is a part of the circulation path. Furthermore, the circulation path may include chamber 55, a fan intake 64, and a supply air duct 63. Fan intake 64 and supply air duct 63 will be explained later.

Heat pump 50 is configured such that a coolant moving along a closed circulation pipe passes through a series of cycle including compression, expansion, evaporation, and condensation. Heat generated from condensation of the coolant is used to heat air.

Heat pump 50 may include a compressor 51 for compressing the coolant, a first heat exchanger 52 for condensing the compressed coolant, an expansion valve (not shown) for expanding the coolant condensed by first heat exchanger 52, and a second heat exchanger 54 for evaporating the coolant passing through the expansion valve. Herein, first heat exchanger 52 corresponds to a heater for heating circulation air. Second heat exchanger 54 corresponds to a condenser for condensing moisture contained in the air.

Condenser 54 and heater 52 may be disposed on the circulation path. In particular, condenser 54 and heater 52 may be sequentially disposed in a progress direction of air. Namely, moisture in circulation air is condensed while passing through condenser 54. In this process, air having low humidity is heated while passing through heater 52.

Chamber 55 forms a part of the circulation path. Condenser 54 and heater 52 may be accommodated in chamber 55. An inlet of chamber 55 may be connected to an outlet of second exhaust air duct 65*b*. An outlet of chamber 55 may be connected to fan intake 64. Air exhausted from second exhaust air duct 65*b* is introduced into chamber 55, passes through condenser 54 and heater 52 to be dehumidified and to be heated, and is introduced into a blower fan 61 through fan intake 64.

A sump 55*a* for collecting condensed water may be formed at chamber 55. Sump 55*a* has a recessed shape to collect condensed water generated in a heat absorbing process of condenser 54. An upper surface of sump 55*a* is opened to mount condenser 54 and heater 52 in sump 55*a*.

Chamber 55 may include a sump cover 55*b* (see FIG. 3) for covering the opened upper surface of sump 55*a*. Sump cover 55*b* has a separable structure from sump 55*a*. Accordingly, condenser 54 and heater 52 may be conveniently mounted in sump 55*a*. Sump cover 55*b* may function to seal not only sump 55*a* but also chamber 55 to prevent air in chamber 55 from leaking. Mount holes, through which a coolant pipe passes, may be formed at sump 55*a*. The mount holes may be sealed in the case that the coolant pipe is mounted.

Fan intake 64 may be formed at a rear part of base 16. Blower fan 61 may be mounted at an outlet side of intake 64. Air guided through fan intake 64 may be forced by blower fan 61. After air is guided along supply air duct 63, air may be supplied to drum 30. According to the illustrated embodiment, motor 62 for rotating drum 30 is commonly used to rotate blower fan 61. However, the present invention is not limited thereto. A motor only for driving blower fan 61 may be provided.

Referring to FIG. 3, supply air duct 63 may be coupled to an outer surface of rear panel 14 to form a path, along which air flows, between rear panel 14 and supply air duct 63. An opening 32 may be formed at rear panel 14 to supply air guided through supply air duct 63 into drum 30.

A supply air hole (not shown) may be formed at a rear surface of drum 30 opposite to rear panel 14. Air exhausted through opening 32 of rear panel 14 is supplied into drum 30. A plurality of supply air holes may be formed.

A rotation axis 41 may be formed at the rear surface of drum 30. Rotation axis 41 may be rotatably coupled to rear panel 14. Thus, a rear end of drum 30 may be firmly supported by rear panel 14.

A condensate pump 84 may be provided to transfer condensed water collected at sump 55*a* to a condensed water container 80. Condensate pump 84 may be mounted at base 16. Condensate pump 84 may be disposed at an outside of sump 55*a*. A pump mount 85*a* for mounting condensate pump 84 may be formed at base 16. A pump cover 85*b* may be separably coupled to pump mount 85*a*. Condensate pump 84 may be covered by pump cover 85*b*.

A water level sensor (not shown) for sensing water level of condensed water collected in sump 55*a* may be provided. A controller (not shown) may control operation of condensate pump 84 based on values sensed by the water level sensor. When the water level sensed by the water level sensor is greater than or equal to a predetermined water level, the controller may operate condensate pump 84.

Condensed water may flow from sump 55*a* to condensate pump 84. An outlet (not shown) for discharging condensed water may be formed at sump 55*a*. Sump 55*a* may communicate with condensate pump 84 through the outlet.

Condensed water forced by condensate pump 84 may be guided through a hose 86 to be transferred to condensed water container 80. An inlet of hose 86 may be connected to condensate pump 84. An outlet of hose 75 may be exposed in a space for accommodating a drawer 70. In addition, a hose through hole 24, through which hose 86 passes, may be formed at drum supporter 20. Hose 86 may be pass through hose through hole 24 and the outlet of hose 86 for discharging condensed water may be disposed at an exposed part in front of drum supporter 20

Drawer 70 may be provided to be movable in a front/rear direction. Drawer 70 may be stored at an inner space of cabinet 10 or may be withdrawn to the outside of cabinet 10. An opening for storing/withdrawing drawer 70 may be formed at front panel 11. A storage space 19 (see FIGS. 1 and 2) to accommodate drawer 70 may be formed in cabinet 10. Drawer 70 may be stored in storage space 19 or be withdrawn from storage space 19 through the opening.

Referring to FIGS. 6 and 7, the clothes dryer may include guide supporters 90 for guiding storing or withdrawing drawer 70 and for supporting movement of drawer 70.

One side of each of guide supporters 90 may be fixed at cabinet 10. The other side of each of guide supporters 90 may be fixed at drawer 70. Two guide supporters 90 may be mounted in a width direction of cabinet 10. Each of guide supporters 90 may be configured to include a plurality of rails 92, 94, and 96 such that each of guide supporters 90 may have a variable length in a front/rear direction. Rails 92, 94, and 96 may include a first rail 92 fixed with respect to cabinet 10, a third rail 96 fixed with respect to drawer 70, and a second rail 94 connected between first rail 92 and third rail 96.

First rail 92 may be fixed to base 16 or sump 55*a*. Although, in the illustrated embodiment, first rail 92 is fixed to a lower surface of sump 55*a*, first rail 92 may be coupled to other parts on base 16.

Third rail 96 may be fixed to a lower part of drawer 70, in particular, a lower surface of a bucket 87. Second rail 94 may move along first rail 92. Third rail 96 may move along second rail 94. Third rail 96 is connected to first rail 92 through second rail 94, and thus a movable distance of drawer 70 is increased, rather than being directly connected to first rail 92.

When second rail 94 and third rail 96 are pressed backwardly to be close to each other, a latch 95 may be further mounted to maintain a compactly close state of first rail 92, second rail 94, and third rail 96. Latch 95 may be locked, in the case that drawer 70 is completely stored, such that a position of second rail 94 and/or third rail 96 may be fixed. Latch 95 may be released, in the case that drawer 70 is pulled to be withdrawn, such that second rail 94 and/or third rail 96 may move.

Base 16 may have a front surface 16*a* (see FIG. 6) opposite to the opening formed at front panel 11. Storage space 19 may be formed between front surface 16*a* and the opening. Front surface 16*a* of base 16 may include an inclined surface, which gradually expands frontward from a rear to a top. Due to the above-described structure, storage space 19 is formed at a lower side of the inclined surface. Condensed water container 80 may have a rear surface 88 opposite to front surface 16*a* of base 16. Rear surface 88 may be inclined to correspond to front surface 16*a*.

Condensed water container 80 may be stored in drawer 70. Condensed water container 80 is capable of being separated from drawer 70. An inlet 81 for introducing condensed water is formed at Condensed water container 80. Condensed water transferred through hose 86 is introduced into condensed water container 80 through inlet 81. Hereinafter, an assembly of drawer 70 and condensed water container 80 is referred as to a drawer assembly.

Referring to FIG. 6, a lateral length w1 of an upper surface of condensed water container 80 may be shorter than a lateral length w2 of a lower surface of condensed water container 80. Accordingly, condensed water container 80 has a cross-sectional view gradually expanding from an upper side to a lower side.

Hose 86 is a constituent separate from condensed water container 80. Thus, drawer 70 is capable of being withdrawn independently with respect to hose 86. In the case that drawer 70 is properly stored in storage space 19, inlet 81 is disposed substantially straight below the outlet of hose 86. Condensed water dropping from the outlet of hose 86 may be collected in condensed water container 80 through inlet 81.

Referring to FIGS. 10 and 11, the clothes dryer may include a drawer sensor 83 to determine whether condensed water container 80 is properly stored or not. Drawer sensor 83 may include a magnet 83*b* disposed at one of drawer 70 and base 16 and a magnetic sensing part 83*a* disposed at the other of drawer 70 and base 16 to sense magnetic field generated by magnet 83*b*. The controller may determine whether drawer 70 is properly stored or not based on degree of a magnetic field sensed by magnetic sensing part 83*a*. For example, when degree of magnetic field sensed by magnetic sensing part 83*a* is greater than or equal to a predetermined value, the controller determines that drawer 70 is properly stored. Only in this case, may the controller control condensate pump 84 to operate.

Unlike the illustrated embodiment, hose 86 may be directly connected to inlet 81. In this case, however, hose 86 may be formed to have a sufficient length to allow withdrawal of drawer 70, or an extensible hose 86 may be provided.

Referring to FIG. 9, drawer 70 may include a front cover 71, a level plate 72 horizontally expanding rearward at a lower end of front cover 71, and bucket 87 disposed above plate 72 while being formed at a rear surface of front cover 71. Condensed water container 80 may be stored in bucket 71.

In the case that condensed water container 80 is stored in bucket 87, front cover 71 covers condensed water container 80. Accordingly, in the case that drawer 70 is stored, condensed water container 80 is not visible outside the clothes dryer. A front surface of front cover 71 and a front surface of front panel 11 may be formed as the front surface of the clothes dryer.

A support rib 89 protruding upward from a bottom surface of bucket 87 may be formed. A plurality of support ribs 89 may be arranged in a front/rear direction. Condensed water container 80 may be held on support ribs 89. Condensed water container 80 is spaced away a distance corresponding to a protruding length of each of support ribs 89 from the bottom surface of bucket 87. Accordingly, a greater amount of condensed water may be stored in bucket 87 (particularly, a space between condensed water container 80 and the bottom surface of bucket 87)

Referring to FIGS. 8, 11 to 13, excess condensed water exceeding the capacity of condensed water container 80 is no longer able to be introduced into inlet 81 and then overflows to be collected in bucket 87. When condensed water which is greater than or equal to a predetermined water level is collected in bucket 87, excess condensed water may be discharged through overflow path 100. Overflow path 100 (see FIG. 8) may include a condensate discharge pipe 103 formed at bucket 87, a sump connection pipe 101 formed at sump 55*a*, and a condensed water return pipe 105 connected to sump connection pipe 101 while having an outlet for discharging condensed water in sump 55*a*.

Condensate discharge pipe 103 may horizontally protrude outside bucket 87 and may communicate with the inner space of bucket 87. Sump connection pipe 101 may horizontally expand from sump 55*a* outwards and may communicate with the inner space of sump 55*a*. In the case that drawer 70 is stored in storage space 19, condensate discharge pipe 103 is connected to sump connection pipe 101 (see FIG. 12). In the case that drawer 70 is separated from storage space 19, condensate discharge pipe 103 is separated from sump connection pipe 101.

An outer diameter of sump connection pipe 101 is less than an inner diameter of condensate discharge pipe 103 such that sump connection pipe 101 may be inserted into condensate discharge pipe 103. An inner diameter of a front end 103*a* of an outlet of condensate discharge pipe 103 may be gradually increased toward the outlet. Due to such a structure of front end 103*a*, although shaking is generated in a process of storing drawer 70, it is easy to insert an inlet of sump connection pipe 101 into the outlet of condensate discharge pipe 103 without dislocation.

Additionally, sump connection pipe 101 may include a ring-shaped extended part 101*c*, which is extended outwards along a circumference at an inlet part 101*a*. Extended part 101*c* is in contact with an inner circumferential surface of condensate discharge pipe 103. In a process of storing or withdrawing drawer 70, condensate discharge pipe 103 may stably move.

A condensed water outlet forming an inlet of condensate discharge pipe 103 may be formed at bucket 87. A valve operation protrusion 87*a* may protrude from the outside of bucket 87 into condensate discharge pipe 103. A plurality of ribs 87*b* may be formed at an outer circumferential surface of valve operation protrusion 87*a* in a radial direction. Ribs 87*b* may be connected to an inner circumferential surface of condensate discharge pipe 103. The condensed water outlet may be formed between adjacent ribs 87*b*

A valve 120 to open/close overflow path 100 may be provided. In the case that drawer 70 is stored, valve 120 opens overflow path 100. In the case that drawer 70 is withdrawn, valve 120 closes overflow path 100. In particular, in the case that condensed water having a high water level is stored in sump 55*a* and condensed water flows backward from sump 55*a* to overflow path 110, overflow path 100 is closed by valve 120. Accordingly, leakage of condensed water through the inlet of sump connection pipe 101 may be prevented.

In sump connection pipe 101, valve 102 may be disposed to be movable in a length direction of sump connection pipe 101. Valve 120 may be elastically supported by spring 130. One end of spring 130 may be coupled to valve 120, and the other end of spring 130 may be fixed in overflow path 100. A spring holder 122 including a hook 122*a* may be formed at valve 120. Hook 122*a* may be coupled to one end of spring 130. A support surface 105*a* for supporting the other end of spring 130 may be formed at condensed water return pipe 105. Support surface 105*a* does not need to be formed at condensed water pipe 105 but may be formed at sump connection pipe 101.

Valve 120 may include a valve body 121 expanding in a length direction of sump connection pipe 101. An outer surface of spring holder 122 may be in contact with an inner surface of sump connection pipe 101. A plurality of spring holders 122 may expand from valve body 121 in a radial direction. A path for condensed water to pass through may be formed between adjacent spring holders 122.

Valve 120 may include a passive protrusion 125 protruding from valve body 121 in an opposite direction to a position where the spring is disposed. In the case that drawer 70 is stored, one end of passive protrusion 125 may be in contact with valve operation protrusion 87*a* by elastic force.

A ring-type flow guide 124 may protrude from an outer circumferential surface of passive protrusion 125. An outer diameter of flow guide 124 is gradually increased toward an outlet of sump connection pipe 101 such that flow guide 124 may be inclined. Condensed water passing through sump connection pipe 101 toward sump 55*a* may be guided to smoothly move due to a space between spring holders 122.

The inlet of sump connection pipe 101 may be opened/closed by valve 120, particularly, valve body 121. In the case that drawer 70 is stored, valve operation protrusion 87*a* presses passive protrusion 125 of valve 120 such that valve 120 moves, spring 130 is compressed, and the inlet of condensate discharge pipe 103 is opened.

Conversely, in the case that the drawer is withdrawn, valve operation protrusion 87*a* is separated from passive protrusion 125 such that valve 120 is restored in position by elastic force of spring 130.

Condensed water return pipe 105 may include an extended part expanding in a vertical direction. An outlet 105*h* may be formed at the lowest end of the extended part expanding in a vertical direction. A height of outlet 105*h* may be less than a height of the outlet of bucket 87 such that condensed water is capable of flowing from bucket 87 to outlet 105*h* without a separate pump.

An inlet of condensed water return pipe 105 is horizontally opened to be connected to the outlet of sump connection pipe 101. However, a section bent downwards between the inlet of condensed water return pipe 105 and outlet 105*a* is provided such that outlet 105*a* is opened toward the lower side. In the case that condensed water which is greater than or equal to a certain water level is collected in sump 55*a*, outlet 105*a* of condensed water return pipe 105 is submerged under condensed water. Thereby, the above-described structure may prevent humid air in cabinet 10 from being introduced into the bucket through overflow path 100.

As apparent from the above description, in accordance with the present invention, the double-sided cooler has the following effects.

First, the clothes dryer may dispose of excess condensed water.

Second, although the collected condensed water exceeds the capacity of a container for condensed water, the clothes dryer may not immediately stop, but may continue a normal operation of the clothes dryer in process.

Third, the clothes dryer may prevent the countercurrent of condensed water in the chamber through the overflow path connected to the drawer although the drawer is withdrawn from the cabinet.

Fourth, the overflow path prevents humid air in the circulation path from leaking out of the clothes dryer.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A clothes dryer comprising:

a cabinet;

a drum rotatably disposed in the cabinet to accommodate clothes;

a condenser disposed in a circulation path passing through the drum to condense humid air exhausted from the drum;

a sump disposed in the circulation path to collect condensed water generated by the condenser;

a drawer withdrawably stored in the cabinet;

a hose connected to the sump;

a condensate pump to transfer condensed water in the sump through the hose; and a condensed water container separably stored in the drawer, wherein the condensed water transferred through the hose is introduced into the condensed water container in a case that the drawer is stored in the cabinet, wherein the drawer comprises:

a bucket to receive condensed water exceeded from the condensed water container; and a condensate discharge pipe formed at the bucket to discharge condensed water collected in the bucket, wherein when the drawer is stored in the cabinet, the sump is connected to the condensate discharge pipe such that condensed water introduced through the condensate discharge pipe is guided to the sump to be returned, and when the drawer is withdrawn from the cabinet, the sump comprises a sump connection pipe separated from the condensate discharge pipe, wherein the clothes dryer further comprising a valve disposed in the sump connection pipe, and a spring, one end of the spring being fixed in the sump connection pipe, and the other end of the spring being connected to the valve, wherein:

the bucket includes a valve operation protrusion protruding into the condensate discharge pipe, and when the condensate discharge pipe is connected to the sump connection pipe, the valve is pressed to move by the valve operation protrusion, and the outlet of the condensate discharge pipe is opened, and when the condensate discharge pipe is separated from the sump connection pipe, the valve moves using elastic force of the spring, and the outlet of the condensate discharge pipe is closed.

2. The clothes dryer of claim 1, wherein the valve comprises:

a valve body expanding in a length direction of the sump connection pipe; and a plurality of spring holders including a hook coupled to the other end of the spring, the spring holders expanding from the valve body in a radial direction.

3. The clothes dryer of claim 2, wherein, in the valve, an outer circumferential surface of each of the spring holders is in contact with a circumferential surface of the sump connection pipe, and wherein a path for condensed water to pass through is formed between the spring holders.

4. The clothes dryer of claim 2, wherein the sump connection pipe is opened/closed by the valve body.

5. The clothes dryer of claim 4, wherein the sump connection pipe is inserted into the condensate discharge pipe.

6. The clothes dryer of claim 5, wherein the condensate discharge pipe includes a part where an inner diameter is gradually increased toward an outlet discharging condensed water.

* * * * *